US006871848B2

(12) United States Patent
Matsushima et al.

(10) Patent No.: US 6,871,848 B2
(45) Date of Patent: Mar. 29, 2005

(54) SHEET CONTAINING APPARATUS, SHEET FEEDING APPARATUS PROVIDED WITH THE SAME, AND IMAGE FORMING APPARATUS

(75) Inventors: Akira Matsushima, Shizuoka (JP); Yasuhiro Uchida, Shizuoka (JP); Makoto Izumi, Shizuoka (JP); Minoru Kawanishi, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 66 days.

(21) Appl. No.: 10/277,036

(22) Filed: Oct. 22, 2002

(65) Prior Publication Data

US 2003/0080497 A1 May 1, 2003

(30) Foreign Application Priority Data

Oct. 26, 2001 (JP) ..... 2001-328695
Oct. 26, 2001 (JP) ..... 2001-328696
Jun. 13, 2002 (JP) ..... 2002-173030

(51) Int. Cl.[7] ..... B65H 1/00
(52) U.S. Cl. ..... 271/171
(58) Field of Search ..... 271/171

(56) References Cited

U.S. PATENT DOCUMENTS 4,245,830 A 1/1981 Fichte et al. ..... 271/164
4,697,803 A * 10/1987 Kan et al. ..... 271/127
4,770,406 A 9/1988 Bodewein et al. ..... 271/223
4,780,740 A * 10/1988 Fukae ..... 399/86
4,786,042 A * 11/1988 Stemmle ..... 271/9.1
4,874,160 A * 10/1989 Yamamoto ..... 271/227
5,188,351 A * 2/1993 Gysling ..... 271/171
5,215,303 A * 6/1993 Yamada et al. ..... 271/240
5,335,903 A * 8/1994 Martin et al. ..... 271/157
5,539,512 A * 7/1996 Mui ..... 399/376
5,647,585 A * 7/1997 Cheong ..... 271/171
5,746,571 A * 5/1998 Dietschi et al. ..... 414/795.7
5,765,826 A 6/1998 Isoda et al. ..... 271/162
5,927,707 A * 7/1999 Miura ..... 271/171
6,254,086 B1 * 7/2001 Sunou et al. ..... 271/171
6,302,390 B1 * 10/2001 Clark et al. ..... 271/171
6,612,564 B1 * 9/2003 Todd ..... 271/145
6,619,656 B2 * 9/2003 Guddanti et al. ..... 271/171
6,651,979 B2 * 11/2003 Shyu ..... 271/171
6,669,188 B1 * 12/2003 Marasco et al. ..... 271/171
6,688,592 B1 * 2/2004 Tan et al. ..... 271/171

FOREIGN PATENT DOCUMENTS

JP 02100930 A * 4/1990 ..... B65H/1/26
JP 04104480 A * 4/1992 ..... H01M/10/40
JP 04350024 A * 12/1992 ..... B65H/1/04
JP 05105266 A * 4/1993 ..... B65H/7/02
JP 05278870 A * 10/1993 ..... B65H/1/04
JP 06016247 A * 1/1994 ..... B65H/1/04
JP 06024578 A * 2/1994 ..... B65H/1/04
JP 2000-318843 11/2000

* cited by examiner

*Primary Examiner*—Donald P Walsh
*Assistant Examiner*—Matthew J Kohner
(74) *Attorney, Agent, or Firm*—Fitzpatrick, Cella, Harper & Scinto

(57) ABSTRACT

A sheet containing apparatus including: a sheet stacking portion which is provided in an apparatus main body and on which sheets are stacked; and a regulating member provided on the sheet stacking portion so as to be movable according to the size of the sheets stacked on the sheet stacking portion and adapted to abut against edges of the stacked sheets to regulate the position of the sheets, in which there is provided a positioning member for effecting positioning on the regulating member on upper and lower sides with respect to the apparatus main body.

15 Claims, 9 Drawing Sheets

SHEET CONTAINING APPARATUS, SHEET FEEDING APPARATUS PROVIDED WITH THE SAME, AND IMAGE FORMING APPARATUS

BACKGROUND OF THE INVENTION

1. Field of the Invention

The present invention relates to a sheet containing apparatus, a sheet feeding apparatus provided with the same, and an image forming apparatus provided with the sheet feeding apparatus and, in particular, to a regulating member for regulating movement of sheets stacked on a sheet stacking means for stacking sheets.

2. Related Background Art

Conventionally, in an image forming apparatus for forming an image on a sheet, such as a printer, facsimile apparatus, copying machine, and a combination of these, there is provided a sheet containing apparatus for containing sheets to be fed to an image forming portion by a sheet feeding apparatus. An example of this sheet containing apparatus is provided with a sheet stacking means for stacking sheets, a side regulating member adapted to move in a direction perpendicular to the sheet feed direction (hereinafter referred to as the "cross direction of a sheet) to regulate the side edges of a sheet, and a trailing edge regulating member adapted to abut against the trailing edges of the stacked sheets on the opposite side to the direction in which the stacked sheets are fed to regulate the position of the sheets in the sheet feed direction, in which the side regulating member and the trailing edge regulating member are moved to their respective predetermined positions in conformity with the sheet size to thereby effect sheet positioning and movement regulation.

Known examples of the positioning method for the regulating members of the conventional sheet containing apparatus include an insertion system in which the regulating members are inserted into insertion holes formed at predetermined positions, and a slide system in which solely the sheet regulating direction of each regulating member is slidably regulated and by inserting a positioning means operated by a lever or the like into an insertion hole formed at a predetermined position at the bottom of each regulating plate, whereby positioning is effected in the sheet regulating direction.

However, in the conventional sheet containing apparatus provided with such regulating members, when, in the case of the insertion system, size change is to be effected, it is necessary to temporarily detach the regulating members from the insertion holes and then reinsert them at predetermined positions, resulting in great consumption of time and effort.

In contrast, in the slide system, it is possible to change the positions of the regulating members solely by sliding the regulating members, so that positioning can be effected easily.

However, in the slide system, the positioning means for the sheet regulating direction is situated below the sheet stacking means, so that the upper portion of an abutment portion of the regulating member abutting against the sheets is subject to deflection so as to open outwardly. Thus, if, when inserting a sheet stack, the abutment portion of the regulating member is pressurized by the sheet stack and its upper portion is outwardly deflected, it is difficult to perform an accurate positioning of the sheet stack above the regulating members, resulting in skew feed or non-feed of the sheet due to the unstableness of the sheet position.

SUMMARY OF THE INVENTION

The present invention has been made in view of the above-mentioned problems in the conventional art. It is an object of the present invention to provide a sheet containing apparatus in which the positioning of the regulating members is facilitated and which allows the accurate positioning of the stacked sheets, and a sheet feeding apparatus and an image forming apparatus provided with such a sheet containing apparatus.

In order to attain the above-mentioned object, according to the present invention, there is provided a sheet containing apparatus including:

a sheet stacking means, which is provided in an apparatus main body and on, which sheets are stacked;

a regulating member provided on the sheet stacking means so as to be movable according to the size of the sheets stacked on the sheet stacking means and adapted to abut against edges of the stacked sheets to regulate the position of the sheets; and a positioning means for effecting a positioning of the regulating member on upper and lower sides with respect to the apparatus main body.

Further, there is provided a sheet containing apparatus including:

a sheet stacking table which is provided so as to be capable of ascending and descending in a sheet storage and which can support sheets of various sizes;

a regulating member provided so as to be movable for the purpose of abutting against edges of the sheets stacked on the sheet stacking table to regulate the position of the sheets; and a pair of lock pins supported by the regulating member so as to be vertically movable, wherein fit holes are formed in upper and lower portions of the sheet storage and the lock pins are fitted into the fit holes, and wherein the fit holes are provided at the positions where the regulating member abuts against the sheets stacked on the stacking table and where the lock pins are fitted into the fit holes.

DESCRIPTION OF THE PREFERRED EMBODIMENT

Figure 1:
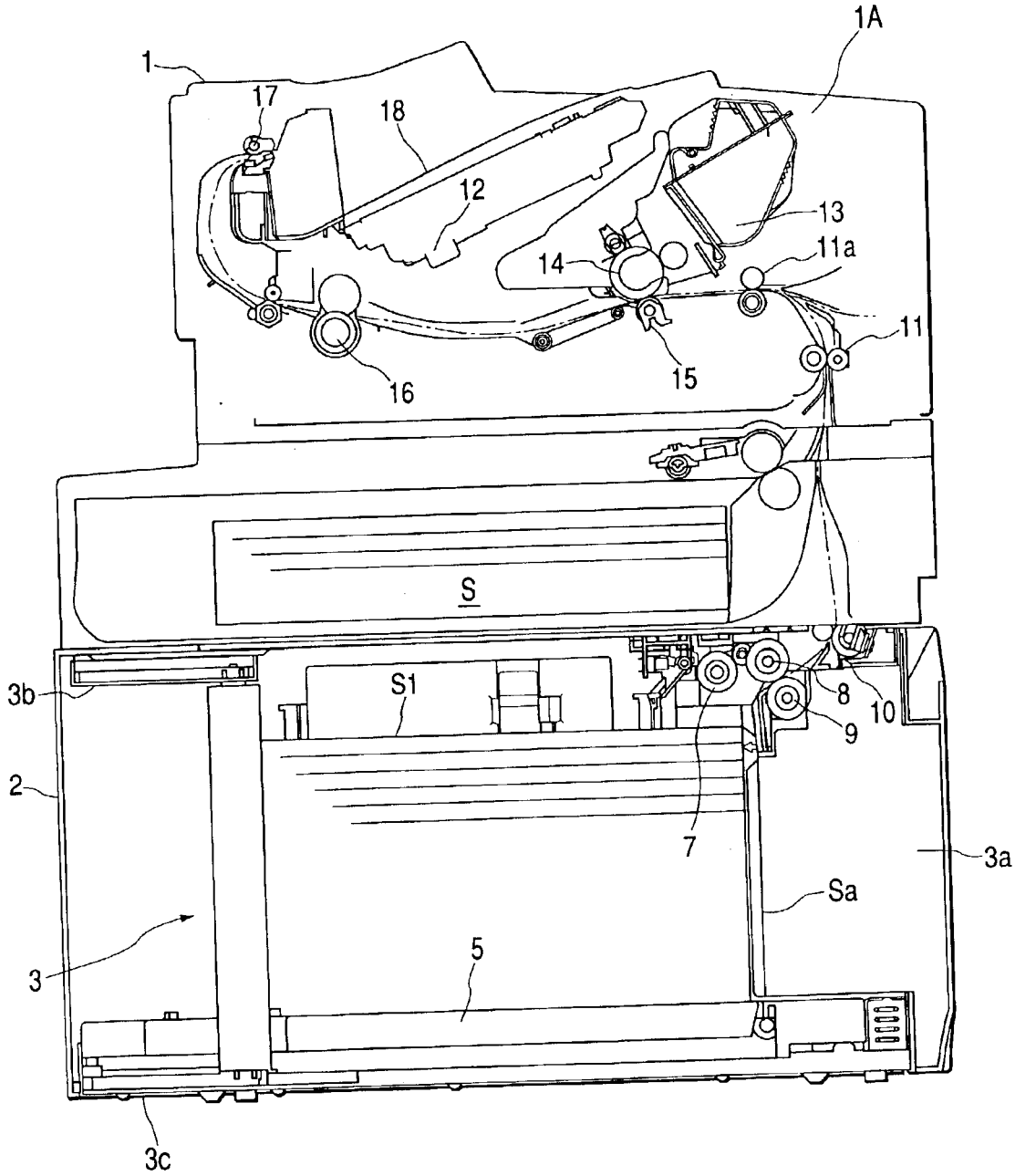
FIG. 1 is an explanatory diagram schematically illustrating the construction of an image forming apparatus provided with a deck type sheet feeding apparatus constituting an example of a sheet feeding apparatus according to a first embodiment of the present invention.
Figure 2:
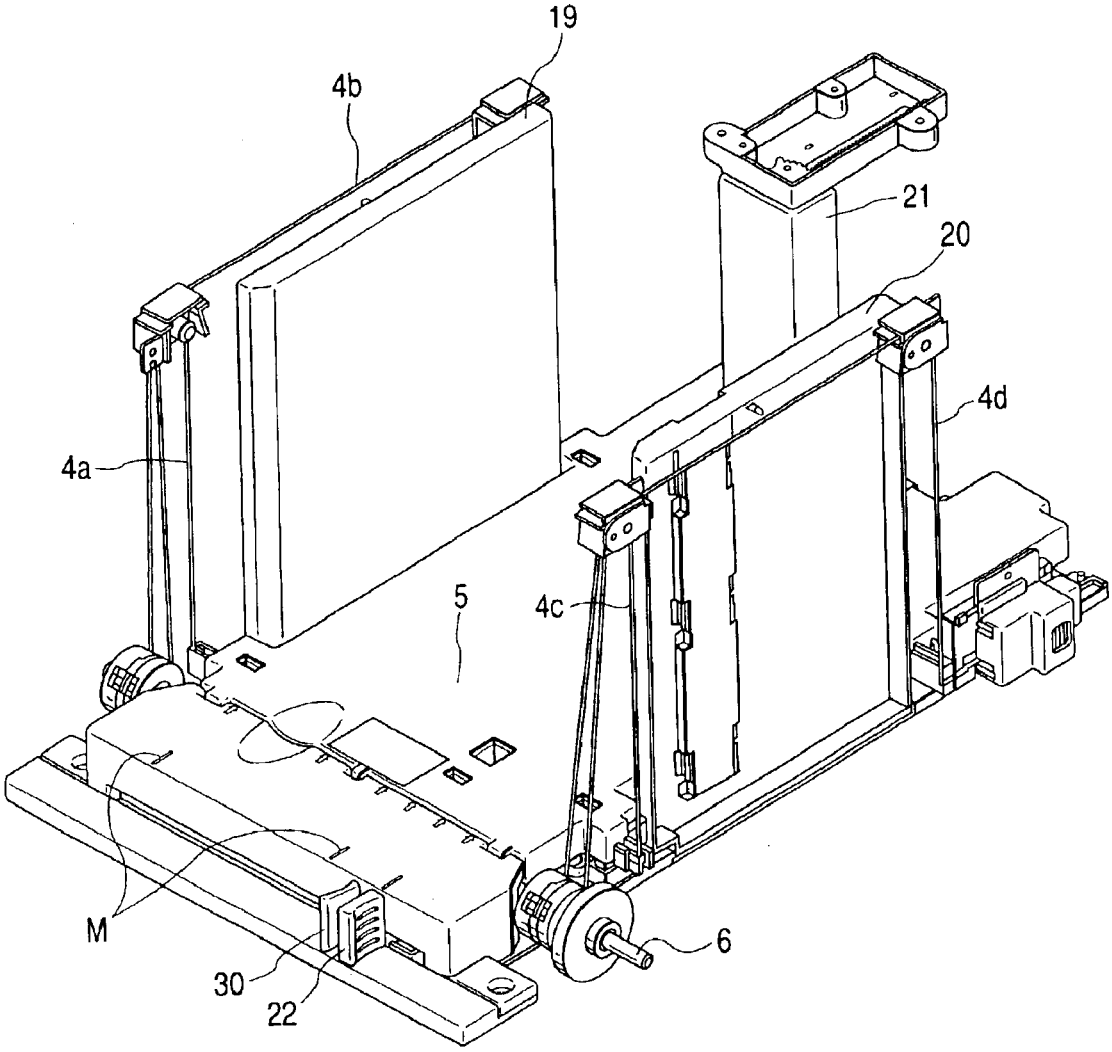
FIG. 2 is a perspective explanatory view of a sheet containing apparatus.
Figure 3:
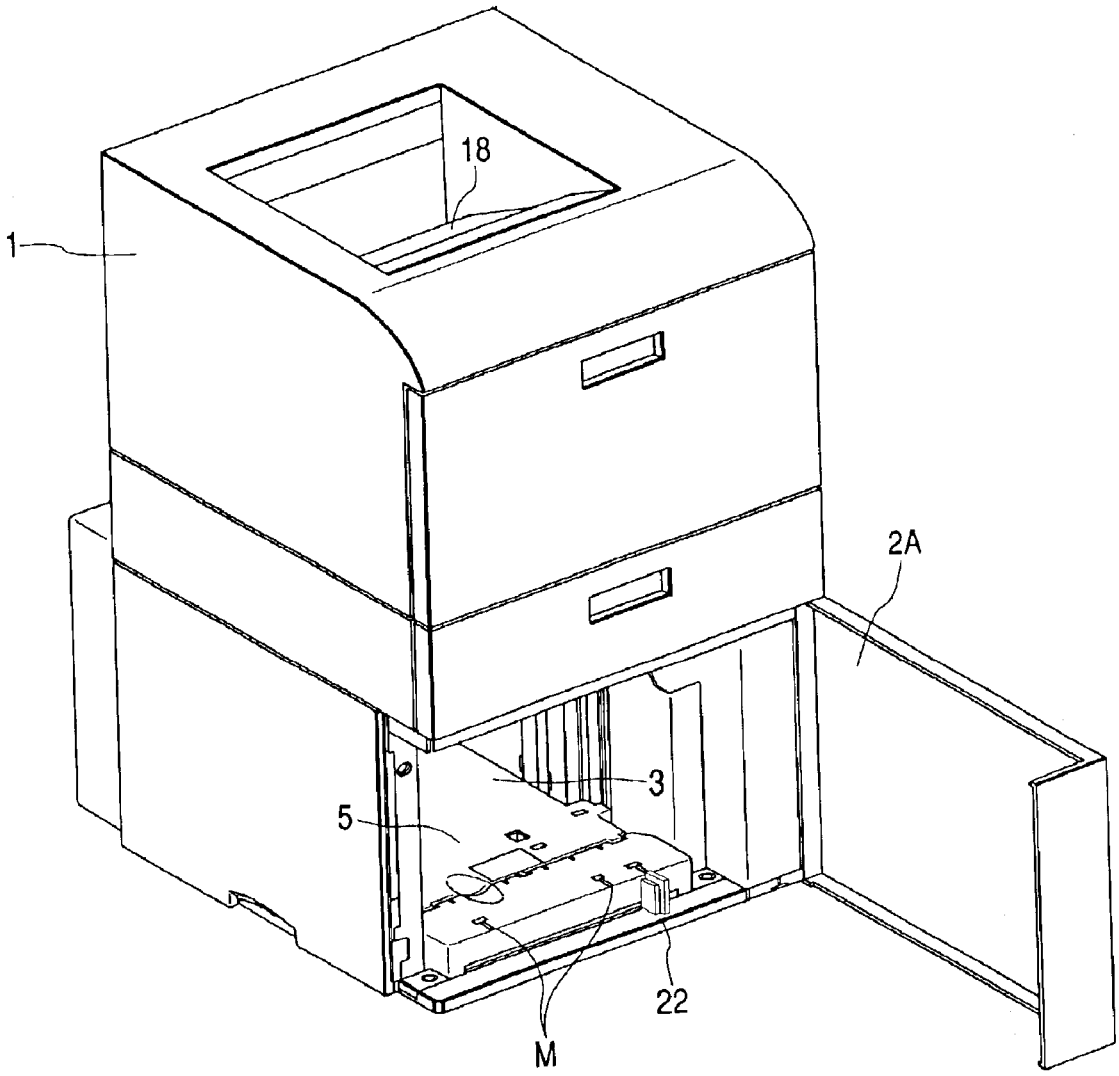
FIG. 3 is an explanatory view showing the sheet feeding apparatus with its door opened.
Figure 4:
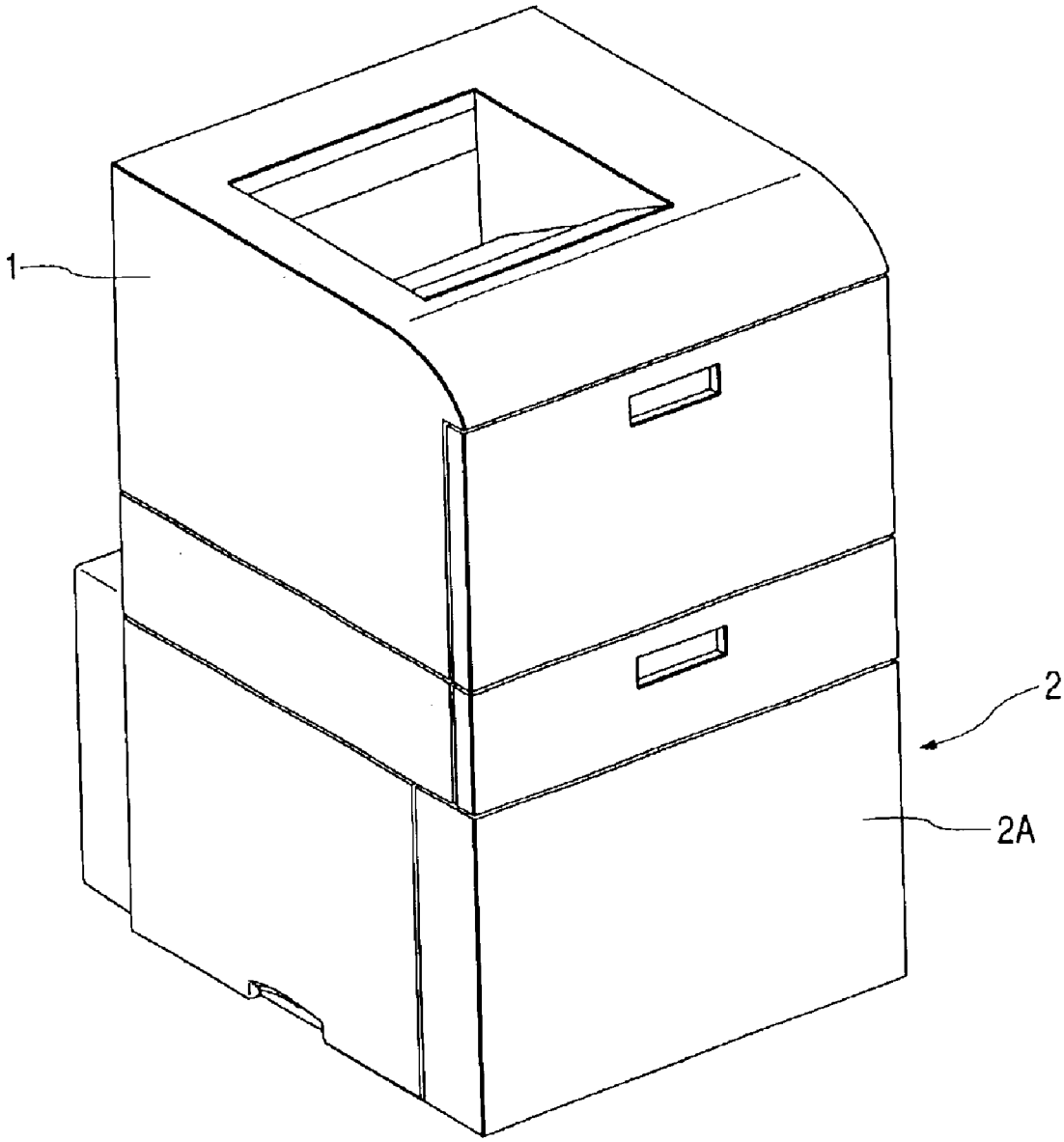
FIG. 4 is an explanatory view showing the sheet feeding apparatus with its door closed.

Next, an image forming apparatus provided with a sheet containing apparatus according to an embodiment of the present invention will be described with reference to the drawings. FIG. 1 is an explanatory diagram schematically illustrating the construction of an image forming apparatus provided with a deck type sheet feeding apparatus constituting an example of a sheet feeding apparatus according to an embodiment of the present invention; FIG. 2 is a perspective explanatory view of a sheet containing apparatus; FIG. 3 is an explanatory view showing the sheet feeding apparatus with its door open; and FIG. 4 is an explanatory outward perspective view showing the sheet feeding apparatus with its door closed.

(Image Forming Apparatus)

First, the general construction of an image forming apparatus as a whole will be described with reference to FIG. 1. In FIG. 1, numeral 1 designates a main body of an image forming apparatus, and numeral 2 designates a deck type sheet feeding apparatus (hereinafter referred to as the "sheet feeding deck") mounted under the main body 1 of the image forming apparatus. Numeral 1A designates an image forming portion provided in the image forming apparatus main body 1 and adapted to perform image formation according to the electrophotographic process. This image forming portion 1A is provided with a photosensitive drum 14 for forming a toner image, a laser scanner 12 for irradiating light in accordance with an image signal to the photosensitive drum 14, a transfer roller 15 for transferring the toner image formed on the photosensitive drum 14 to a sheet S, etc.

And, when, in the image forming portion 1A constructed as described above, image forming operation is started, light in accordance with an image signal is first applied to the photosensitive drum 14 by the laser scanner 12, and a latent image is formed on the photosensitive drum through this irradiation of light. Next, the latent image is developed with toner contained in a toner cartridge 13, whereby a toner image (visible image) is formed on the photosensitive drum 14.

When, concurrently with the toner image forming operation, a sheet S is fed from the sheet feeding deck 2 as described below, the sheet S is transported by a transport roller 11, and transported by a registration roller 11*a* to a transfer portion formed by the photosensitive drum 14 and the transfer roller 15 in synchronism with the image formed on the photosensitive drum 14. And, in this transfer portion, bias is applied to the transfer roller 15, whereby the toner image is transferred to the sheet S.

The sheet S, to which the toner image has been thus transferred, is thereafter transported to a fixing means 16, and by being heated in this fixing means 16, the toner image is fixed. Thereafter, the sheet is delivered to a delivery portion 18 in the upper portion of the apparatus by a delivery roller 17.

(Sheet Feeding Deck)

Next, the construction of the sheet feeding deck 2 will be described. As shown in FIG. 1, the sheet feeding deck 2 is provided in a sheet storage (apparatus main body) 3*a* containing sheets S so as to be capable of ascending and descending, and comprises a sheet containing apparatus 3 provided with a sheet stacking table 5 constituting the sheet stacking means for stacking a sheet stack Sa and regulating members 19, 20, and 21 (See FIG. 2) described below, a sheet supply roller 7 constituting the sheet feeding means for sending out the uppermost sheet S1 of the sheet stack Sa stacked on the sheet stacking table 5, a feed roller 8 adapted to rotate in the direction in which the sheets S sent out by the sheet supply roller 7 are fed, a retard roller 9 to be rotated at a predetermined torque through a torque limiter (not shown) in a direction, in which the sheets S fed by the feed roller 8 is returned, and a transport roller 10 for transporting the sheets S separated and fed one by one by the feed roller 8 and the retard roller 9 to the image forming apparatus main body 1. The feed roller 8 and the retard roller 9 constitute a retard separation type separation roller pair 8, 9.

As shown in FIG. 2, the sheet stacking table 5 is suspended by wires 4*a*, 4*b*, 4*c*, and 4*d*, and is adapted to move vertically (ascend and descend) by taking up or paying out the wires 4*a*, 4*b*, 4*c*, and 4*d* by a wire take-up shaft 6.

Further, as shown in FIG. 3, the sheet feeding deck 2 is provided with a door 2A adapted to be opened when stacking the sheet stack Sa on the sheet stacking table 5. This door 2A is arranged on the front side of the image forming apparatus main body 1, and allows putting in and out of the sheets S from the operation side of the image forming apparatus main body 1. And, in this embodiment, when the door 2A is opened as shown in FIG. 3, the wire take-up shaft 6 is rotated in the forward rotative direction by a control portion (not shown) which detects this, whereby the wires 4*a*, 4*b*, 4*c*, and 4*d* are paid out, and the sheet stacking table 5 descends to the lowermost position shown in FIG. 3.

When the stacking of the sheet stack Sa on the sheet stacking table 5 is completed and the door 2A is closed as shown in FIG. 4, the wire take-up shaft 6 is rotated in the reverse rotative direction by the control portion (not shown) detecting this, whereby the wires 4*a*, 4*b*, 4*c*, and 4*d* are taken up and the sheet stacking table 5 ascends.

And, thereafter, the sheet stacking table 5 is controlled in height through ascent and descent by the control portion (not shown) on the basis of a signal from a sheet surface detecting means (not shown) such that the uppermost sheet S1 of the sheet stack Sa stacked is fed by the sheet supply roller 10 and moves to a position where it can smoothly enter the nip of the separation roller pair 8, 9, maintaining this position.

In FIG. 2, numerals 19 and 20 designate plate-like side regulating members provided on the sheet stacking table 5 so as to be opposed to each other and adapted to regulate cross-direction movement of the sheets S on the sheet stacking table 5; numeral 19 designates a reference-side side regulating member for determining a reference feed position in a direction crossing the sheet feeding direction (hereinafter referred to as the cross direction of the sheets), and numeral 20 designates a non-reference-side side regulating member provided with a push-aside plate (not shown). On the side of the non-reference-side side regulating member 20 regulating the sheets, there is provided a push-aside plate, which is urged by a spring as an elastic member, whereby the sheets S on the sheet stacking table 5 are pressed against the reference-side side regulating member 19, thereby regulating the position of the sheets S in the cross direction.

Further, numeral 21 designates a trailing edge regulating member provided in the depth side with respect to the direction in which the sheets are put in and adapted to regulate the trailing edge of the sheet stack. Further, numeral 22 designates an operating lever constituting the operating means; when the user moves this operating lever 22, the side regulating members 19 and 20 and the trailing edge regulating member 21 move in association with the operating lever 22, whereby it is possible to change the size of the sheets to be stacked. In this embodiment, it is possible to stack three kinds of sheets on the sheet stacking table 5: letter size sheets, A4 size sheets, and legal size sheets; there are provided marks M for these sizes. By adjusting the position of the operating lever 22 to these marks M, it is possible to place the side regulating plates 19 and 20 and the trailing edge regulating plate 21 at positions according to the size of the sheets to be stored. The size of sheets to be stacked is not restricted to the above sheet sizes.

(Construction for Moving the Regulating Members)

Figure 5:
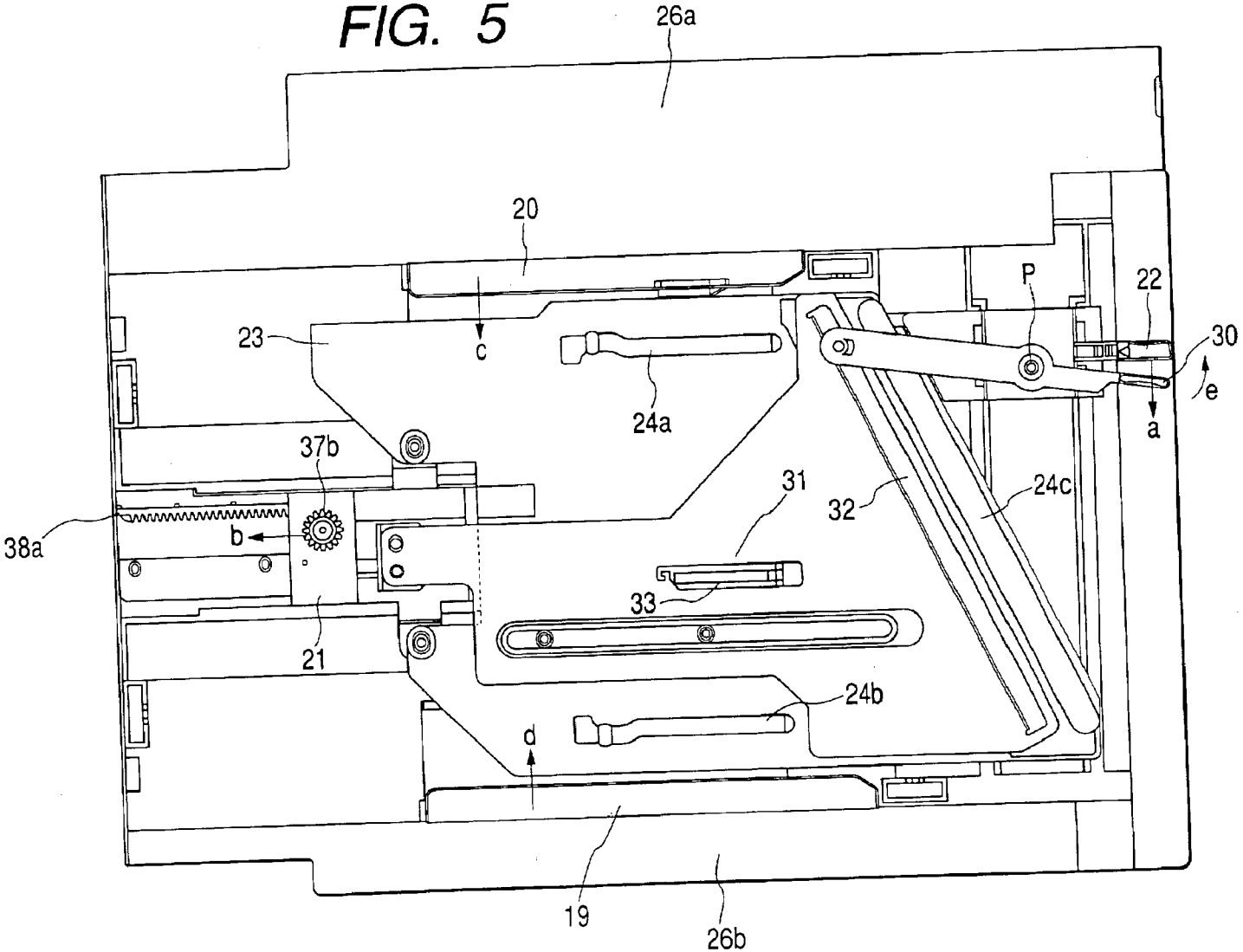
FIG. 5 is an explanatory diagram illustrating a mechanism for operating regulating members provided under a sheet stacking table.

FIG. 5 is an explanatory diagram illustrating a mechanism for moving the regulating members 19, 20, and 21 provided under the sheet stacking table 5.

In FIG. 5, the operating lever 22 is provided so as to be capable of sliding along the opening front edge on the door 2A side of the sheet storage 3*a*. Numeral 23 designates a board member serving as a connection member; this board member 23 is engaged with the operating lever 22 through the intermediation of a slit portion 24*c* that is obliquely formed; when the operating lever 22 is slid in the direction indicated by the arrow "a" in FIG. 5 by the slit portion 24*c*, the board member 23 moves in the direction indicated by the arrow "b", which direction is perpendicular to the direction in which the operating lever 22 moves.

Here, the trailing edge regulating member 21 is connected to this board member 23; when the board member 23 thus moves in the direction indicated by the arrow "b" upon operation of the operating lever 22, the trailing edge regulating member 21 moves in association with this movement in the direction indicated by the arrow "b" (the direction reverse to the sheet feeding direction) along a slit (not shown). When the operating lever 22 is moved in a direction reverse to the direction indicated by the arrow "a", the trailing edge regulating member 21 moves in the direction (sheet feeding direction) reverse to the direction indicated by the arrow "b".

Further, this board member 23 is provided with slit portions 24*a* and 24*b* engaged with the reference-side side regulating member 19 and the non-reference-side side regulating member 20; due to this arrangement, when the board member 23 moves, the slit portions 24*a* and 24*b* move, and, along the configurations of the slit portions, the two side regulating members 19 and 20 provided opposite to each other move symmetrically in the directions indicated by the arrows "c" and "d" shown in FIG. 5.

In this way, when the operating lever 22 is operated, the trailing edge regulating member 21 moves forwards or backwards and the two side regulating members 19 and 20 move toward or away from each other, whereby the two side regulating members 19 and 20 and the trailing edge regulating member 21 can be moved easily.

(Construction for Performing Positioning on the Trailing Edge Regulating Member)

In the trailing edge regulating member 21, there is provided a positioning means for fixing the trailing edge regulating member 21 at a predetermined position; by rotating a lock lever 30 provided on the operating lever 22 for moving the trailing edge regulating member 21 and the side regulating members 19 and 20, it is possible to fix/release the trailing edge regulating member 21.

Figure 6:
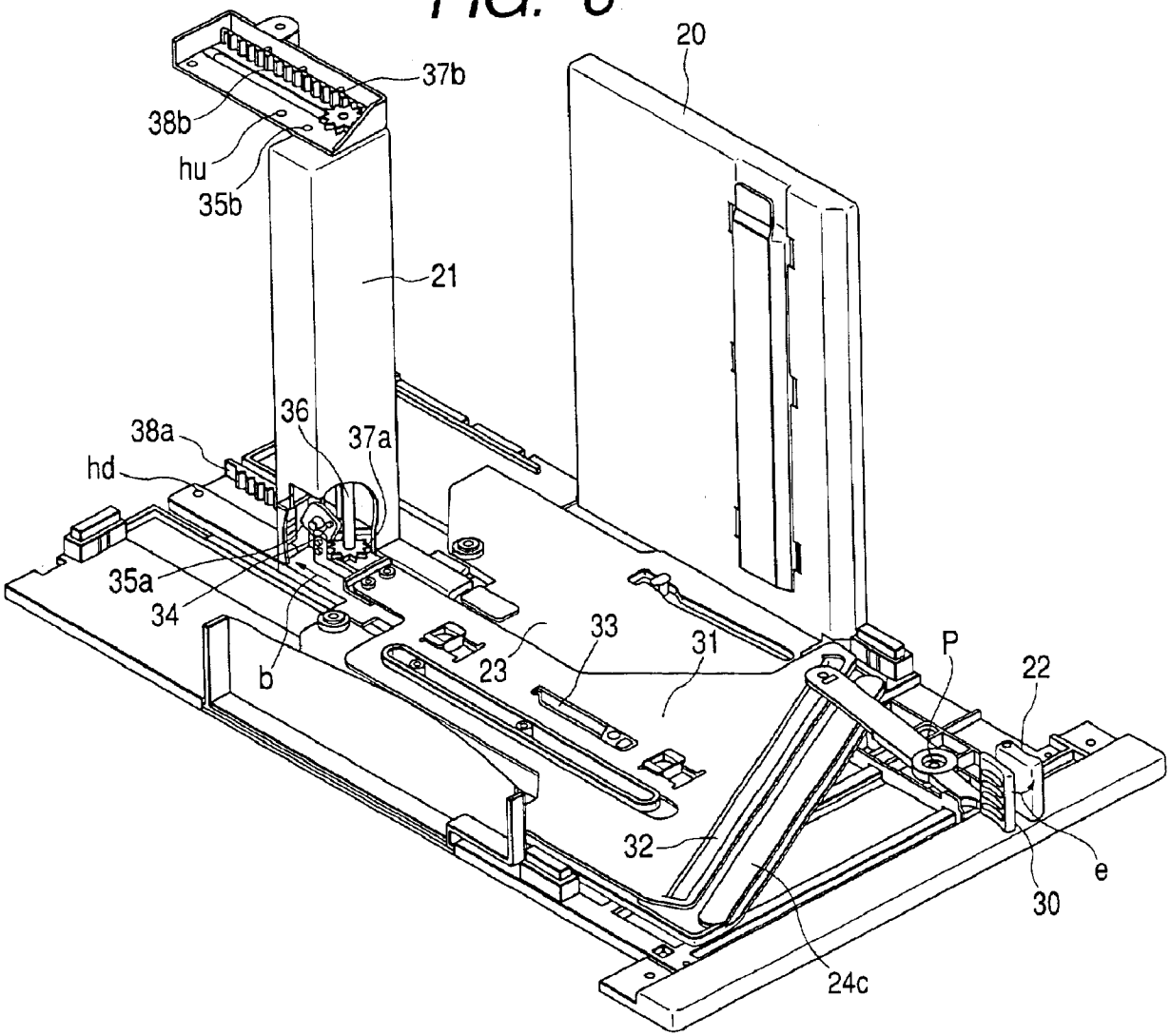
FIG. 6 is an explanatory diagram showing the construction of a positioning means of a trailing edge regulating member.
Figure 7:
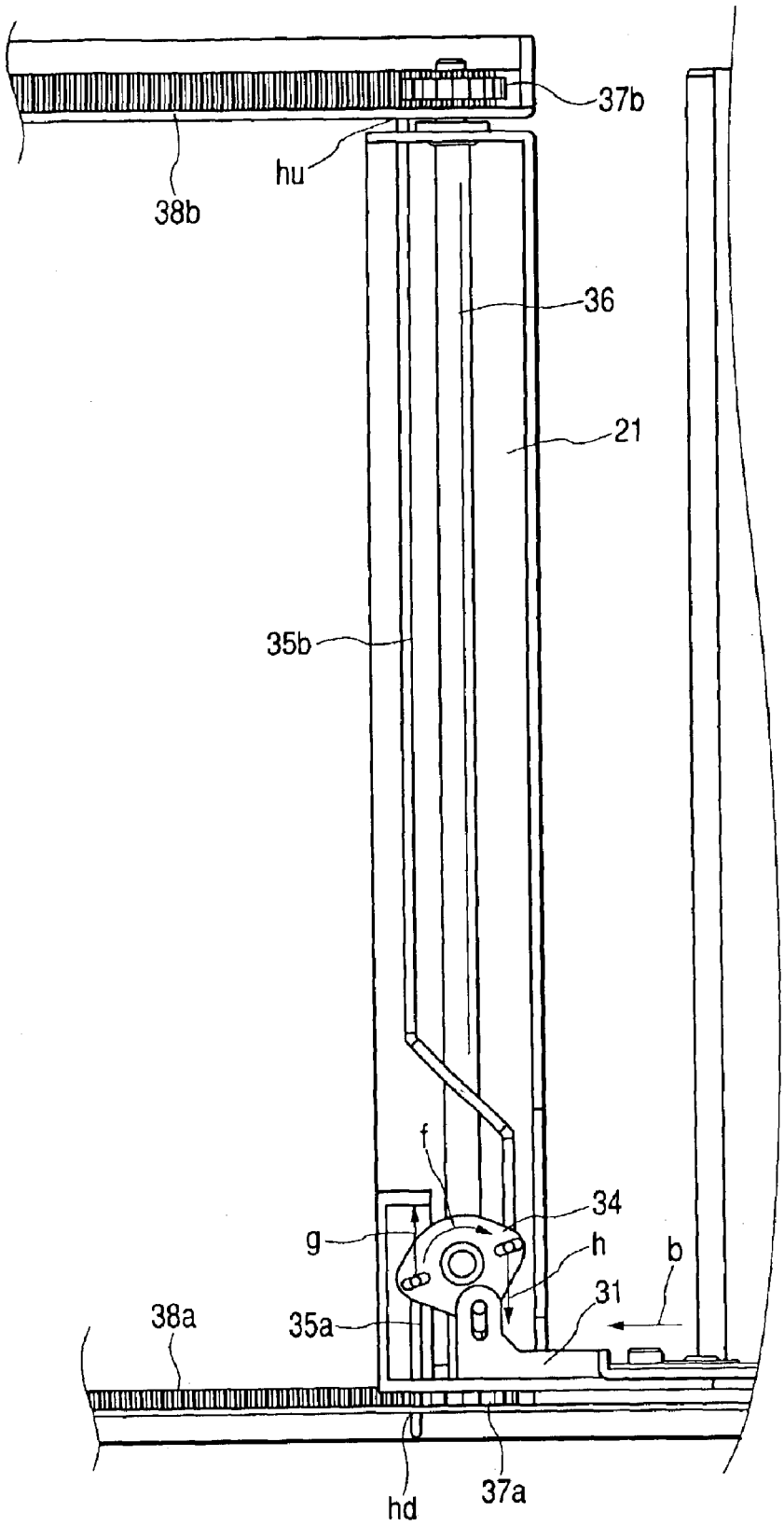
FIG. 7 is an explanatory diagram showing the construction of the positioning means of the trailing edge regulating member.

FIGS. 6 and 7 are diagrams showing the construction of the positioning means for the trailing edge regulating member 21.

In FIGS. 6 and 7, the lock lever 30 is rotatably supported by the operating lever 22 at a fulcrum P. Numeral 31 designates a connecting member for connecting the positioning means and the lock lever 30, and its engagement with the lock lever 30 is effected through a slit portion 32 formed substantially parallel to a slit portion 24*c* formed in the board member 23. And, independently of the position to which the operating lever 22 is moved, when the lock lever 30 is rotated in the direction indicated by the arrow "e" of FIG. 6, the connecting member 31 moves in the direction indicated by the arrow "b". Numeral 33 designates an elastic member (spring), which urges the connecting member 31 in the direction reverse to the direction indicated by the arrow "b"; when the force causing the lock lever 30 to rotate in the direction indicated by the arrow "e" is removed, the connecting member 31 moves in the direction opposite to the direction indicated by the arrow "b", and the lock lever 30 returns to the home position.

Here, as shown in FIG. 7, the connecting member 31 is connected to a cam 34 provided in the trailing edge regulating member 21, and the cam 34 is connected to two lock pins 35*a* and 35*b* supported so as to be vertically movable. Formed at predetermined positions of a top plate portion 3*b* and a bottom plate portion 3*c* of the sheet storage 3*a* are an upper fit hole "hu" and a lower fit hole "hd" into which the lock pins 35*a* and 35*b* are inserted for fitting engagement. The upper fit hole "hu" and the lower fit hole "hd" are formed at positions where the trailing edge regulating member 21 is fixed so that sheets of the three types: letter size sheets, A4 size sheets, and legal size sheets, can be regulated. The position where the trailing edge regulating member 21 is regulated is not restricted to these sheet sizes; fit holes may be provided at positions corresponding to various sheet sizes.

As shown in FIG. 7, in the state in which the lock lever 30 is not being operated, the connecting member 31 is urged by the elastic member 33 in the direction opposite to the direction indicated by the arrow "b", so that the lock pins 35*a* and 35*b* are respectively fitted into the upper fit hole "hu" and the lower fit hole "hd". Thus, the trailing edge regulating member 21 is locked. And, when the lock lever 30 is operated, and the connecting member 31 moves in the direction indicated by the arrow "b", the cam 34 rotates in the direction indicated by the arrow "f" of FIG. 7, and the upper and lower lock pins 35*a* and 35*b* connected to the cam 34 respectively move in the directions indicated by the arrows "g" and "h", with the result that the fitting engagement of the lock pins 35*a* and 35*b* with the upper fit hole "hu" and the lower fit hole "hd" constituting the fit portions formed in the top plate portion 3*b* and the bottom plate portion 3*c* is respectively released, and the lock is canceled.

(Construction of the Movement Guide for the Trailing Edge Regulating Member)

Further, the trailing edge regulating member 21 is provided with a rotation shaft 36 disposed along the vertical direction so as to be rotatable, and pinion gears 37*a* and 37*b* are respectively provided at the ends of this rotation shaft 36. Further, in the top plate portion 3*b* and the bottom plate portion 3*c* at the upper and lower positions of the trailing edge regulating member 21, there are provided rack portions 38*a* and 38*b* so as to be in mesh with the pinion gears 37*a* and 37*b*, the rack portions 38*a* and 38*b* being provided in the same phase and in the same configuration in the sheet transporting direction. Thus, due to the rack portions 38*a* and 38*b* and the pinion gears 37*a* and 37*b* provided at the top and bottom of the trailing edge regulating member 21, it is possible for the trailing edge regulating member 21 to move in parallel without involving any inclination or deflection in the vertical direction.

Due to this arrangement, the engagement of the lock pins 35*a* and 35*b* provided at the top and bottom with the upper fit hole "hu" and the lower fit hole "hd" formed in the top plate portion 3*b* and the bottom plate portion 3*c* can be locked/released through operation of the lock lever 30 without involving any phase shift between the top portion and the bottom portion, and the trailing edge regulating member 21 is not deflected even when a great amount of sheets are stacked. As a result, it is possible to effect positioning of the sheet stack accurately also in the upper portion of the trailing edge regulating member 21.

In this way, there are provided at the top and bottom of the trailing edge regulating member two pinion gears 37*a* and 37*b* of the same configuration adapted to rotate coaxially and two rack portions 38*a* and 38*b* of the same configuration in mesh with the pinion gears to provide a phase matching mechanism for effecting phase matching between top and bottom, and further, two pins for positioning are fitted into upper and lower fit holes, whereby it is possible to firmly lock the trailing edge regulating member 21. Thus, the trailing edge regulating member 21 is not deflected by the weight of the sheets, etc. Further, even if the sheet stack is impulsively inserted into the sheet storage 3*a*, it does not undergo deformation, making it possible to reliably regulate the trailing edge of the sheets. This makes it possible to mitigate skew feed, non-feed or the like, making it possible to supply sheets in a stable manner.

(Construction for Supporting the Side Regulating Plates)

Figure 8A:
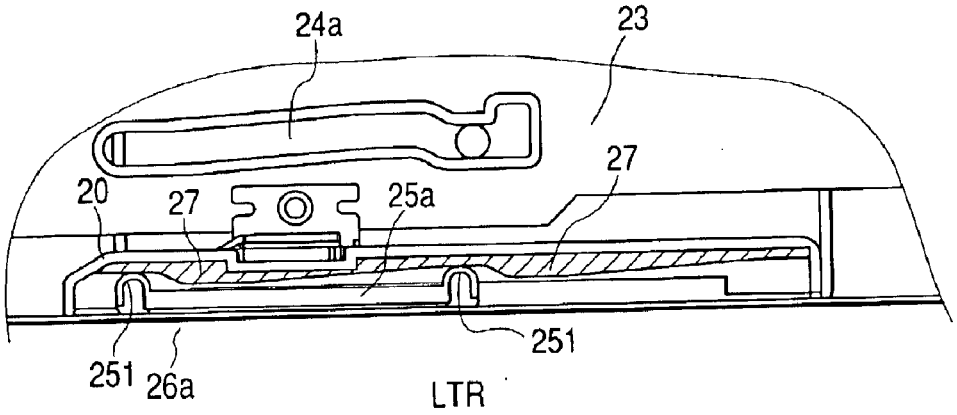
FIGS. 8A, 8B, and 8C are main-portion explanatory sectional views showing how sheet size changing is effected in the sheet containing apparatus.
Figure 8B:
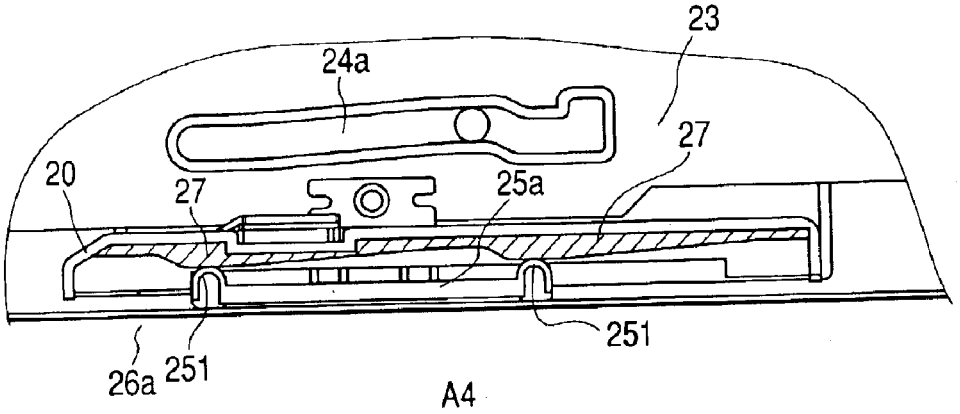
Figure 8C:
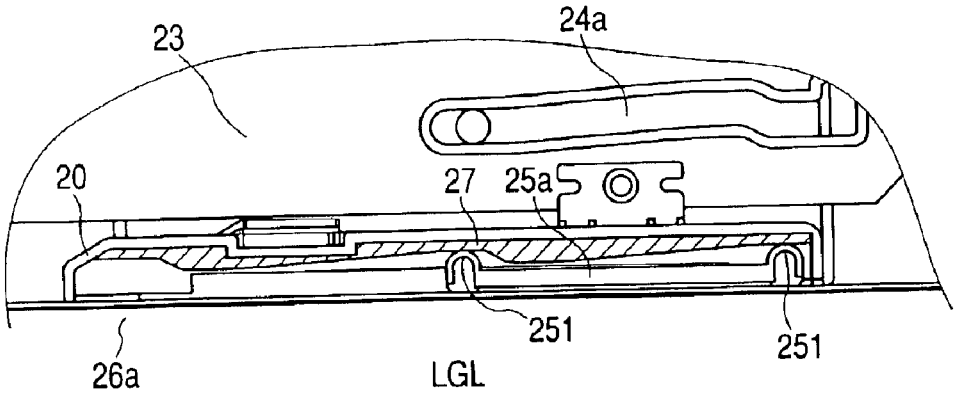
Figure 9A:
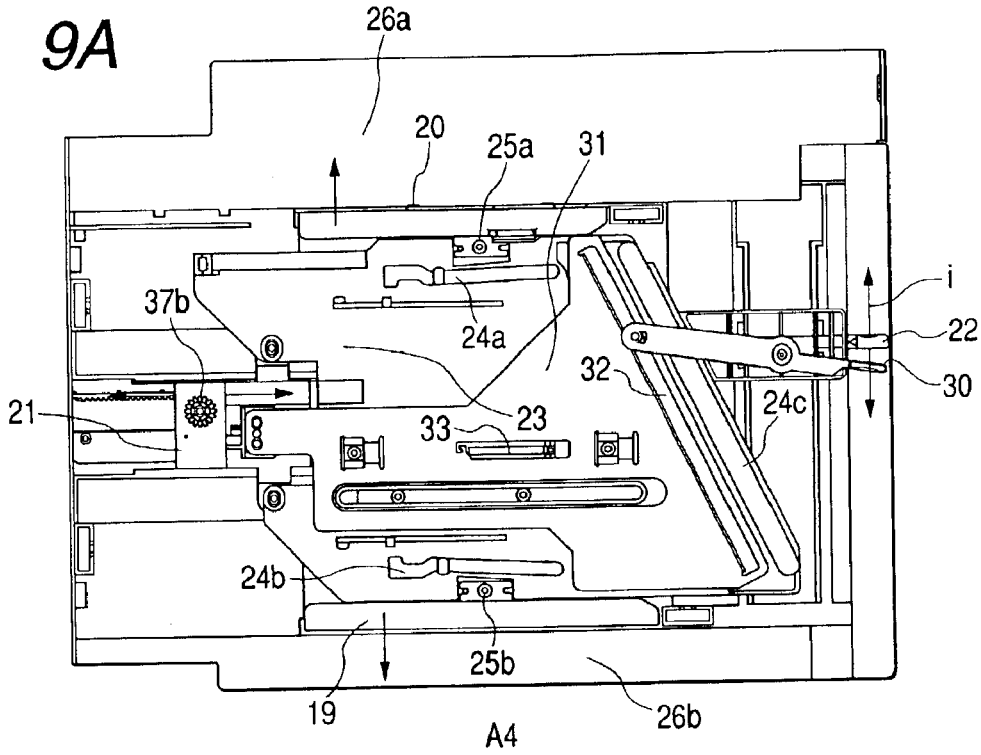
FIGS. 9A and 9B are explanatory bottom views showing how sheet size changing is effected in the sheet containing apparatus.
Figure 9B:
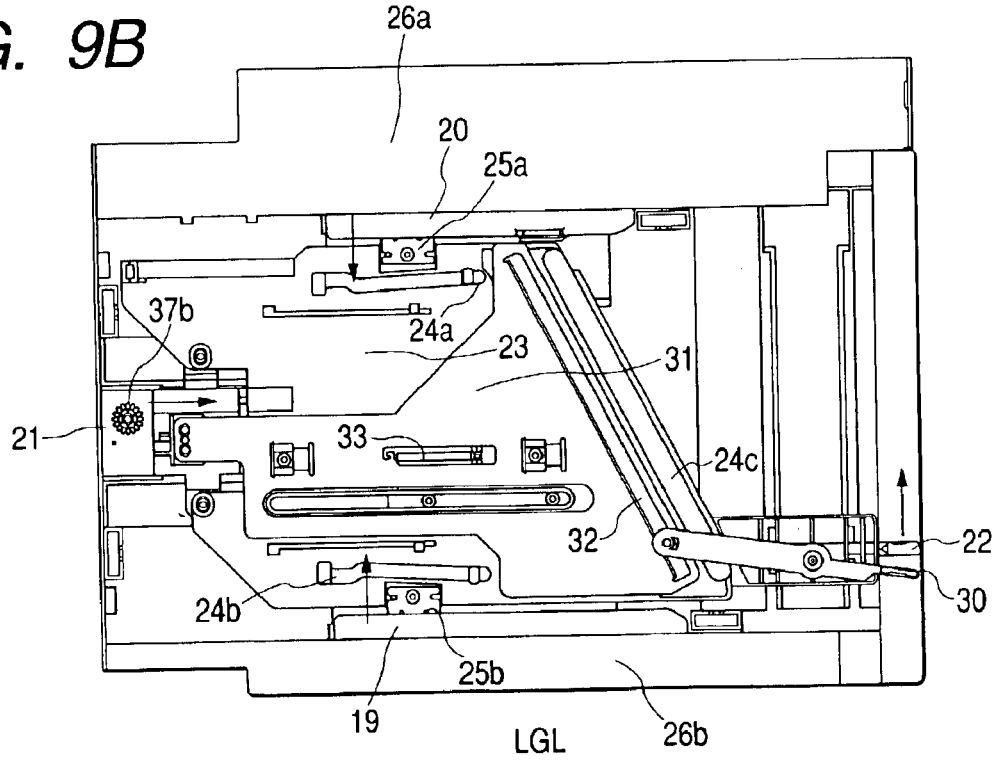

FIGS. 8A, 8B, and 8C illustrate in detail the support construction for the non-reference-side side regulating plate 20. The reference-side side regulating plate 19 has the same structure. FIGS. 9A and 9B are bottom views of the sheet containing apparatus 3.

As shown in FIGS. 8A, 8B, 8C, 9A, and 9B, the board member 23 is provided with arm members 25*a* and 25*b* situated between the two side regulating plates 19 and 20 and the frames 26*a* and 26*b* of the feeding deck 2, and these arm members 25*a* and 25*b*, which are abutment members, move between the two side regulating plates 19 and 20 and the frames 26*a* and 26*b* constituting the feeding deck main body when the board member 23 moves.

As shown in FIGS. 8A, 8B, and 8C, in the upper portion of the back surface of the non-reference-side side regulating plate 20 on the opposite side of the sheet abutment surface abutting the sheet stack, there is provided a rib form 27 constituting an abutment portion abutting against a protrusion 251 provided on the arm member 25*a*. Further, though not shown, a similar rib form is provided in the upper portion of the back surface of the reference-side side regulating plate 19.

Here, the rib form 27 has a configuration (step portion) such that when, for example, the reference-side side regulating plate 19 and the non-reference-side side regulating plate 20 move from the position where they regulate letter size (LTR) sheets shown in FIG. 8A to the position where they regulate A4 size sheets shown in FIG. 8B with the movement of the board member 23, the rib form 27 abuts against the protrusion 251 of the arm member 25*a* which has moved with the board member 23.

And, when the reference-side side regulating plate 19 and the non-reference-side side regulating plate 20 have thus moved to the position of FIG. 8B where they regulate A4 size sheets, the arm member 25*a* which has moved with the board member 23 and the rib form 27 (i.e., the protruding step portion thereof) abut against each other, whereby the two side regulating plates 19 and 20 are supported from the back side by the arm members 25*a* and 25*b*. Since the arm members 25*a* and 25*b* abut against the frames 26*a* and 26*b*, positioning is reliably effected on the two side regulating plates 19 and 20.

Thus, even when a great amount of sheets are stacked, there is no danger of the two side regulating plates 19 and 20 being deflected toward the back side. As a result, positioning can be accurately effected on the sheet stack even in the upper portions of the two side regulating plates 19 and 20.

(Operation of the Regulating Plates)

Next, the operation of the three regulating plates 19, 20, and 21 when changing the stacked sheets will be described. Here, their operation when the sheets stacked are changed from the letter size (215.9 mm width×279.4 mm length) to the A4 size (210 mm width×297 mm length) and the legal size (215.9 mm width×355.6 mm length) will be described.

FIG. 5 shows the respective positions of the three regulating plates 19, 20, and 21 when letter size sheets are stacked. In this embodiment, the distance between the sheet feeding position and the trailing edge regulating plate 21 is set at approximately 279.4 mm, and the distance between the side regulating plates 19 and 20 is set at approximately 216 mm.

When A4 size sheets are to be stacked, the user rotates the lock lever 30 in the direction indicated by the arrow "e" of FIG. 5 to release the lock state of the trailing edge regulating plate 21, and moves the operating lever 22 in the direction indicated by the arrow "a" to the A4 size position shown in FIG. 9A. When the operating lever 22 is thus moved, the trailing edge regulating plate 21 is moved in the direction indicated by the arrow "b" of FIG. 5 by the board member 23. The moving amount of the trailing edge regulating plate 21 at this time is approximately 17.6 mm, and when the trailing edge regulating plate 21 moves as described above, the lock pins 35*a* and 35*b* formed on the trailing edge regulating plate 21 are fitted into the fit holes previously formed as described above; when A4 size sheets are stacked, the leading edge of the sheets is set at the sheet feeding position.

When the operating lever 22 is moved in the direction indicated by the arrow "a" as described above, the two side regulating plates 19 and 20 are moved to their positions in conformity with the configuration of the slits 24*a* and 24*b* provided in the board member 23. When the sheet size is thus set to A4 size, the two side regulating plates 19 and 20 both move inwardly from the letter size position by approximately 3 mm, and the distance between the side regulating plates 19 and 20 becomes approximately 210 mm.

When the board member 23 moves through this operation of the operating lever 22, the arm members 25*a* and 25*b* mounted to the board member 23 move along the frames 26*a* and 26*b* and the side regulating plates 19 and 20.

Here, at the A4 size position shown in FIG. 8B, the rib forms 27 provided on the side regulating plates 19 and 20 are offset by 3 mm as compared with the case of the letter size like the configuration of the slits 24*a* and 24*b* of the lower board member 23, so that when the side regulating plates 19 and 20 move inwards by approximately 3 mm, the arm members 25*a* and 25*b* and the protruding step portions of the rib forms 27 provided on the side regulating plates 19 and 20 abut against each other. At this time, the opposite sides of the arm members 25*a* and 25*b* are constantly in contact with the frames 26*a* and 26*b*.

With this arrangement, the side regulating plates 19 and 20 are regulated in deflection toward the back side by the frames 26*a* and 26*b* through the arm members 25, so that when the sheets S are inserted, even if the side regulating plates 19 and 20 are pressurized by the weight of the sheets S, the side regulating plates 19 and 20 are not deflected, and it is possible to accurately stack A4 size sheets.

When changing from the A4 size to the legal size, the operating lever 22 is operated in the direction indicated by the arrow "i" shown in FIG. 9A to effect movement from the A4 size position to the legal size position. And, through this operation of the operating lever 22, the trailing edge regulating plate 21 moves by 58.6 mm, and the side regulating plates 19 and 20 move outwards by 3 mm.

And, even when the side regulating plates 19 and 20 are thus moved, the arm member 25*a* abuts against the rib form 27 of the non-reference-side side regulating plate 20, so that it is possible to prevent the non-reference-side side regulating plate 20 from being deflected by the weight of the sheets S, whereby legal size sheets can also be stacked while effecting positioning thereon accurately.

In this way, by operating the operating lever, the regulating plates 19, 20, and 21 can be moved for positioning.

What is claimed is:

1. A sheet containing apparatus comprising:

sheet stacking means, which is provided in a main body of said sheet containing apparatus and on which sheets are stacked;

a regulating member movable according to a size of the sheets stacked on said sheet stacking means and for abutting against edges of the stacked sheets to regulate a position of the sheets;

an upper fit portion and a lower fit portion provided at positions corresponding to the size of the sheets stacked on said sheet stacking means in an upper portion and a lower portion of said main body;

an upper positioning member and a lower positioning member provided on said regulating member and for being fitted into said fit portions; and operating means for engaging said positioning members with said fit portions, wherein said upper positioning member is engaged with said upper fit portion and said lower positioning member is engaged with said lower fit portion by one operation of said operating means.

2. A sheet containing apparatus according to claim 1, wherein said positioning members are fitted into said fit portions so that said regulating member can be positioned in a position corresponding to the size of the sheets stacked on said sheet stacking means.

3. A sheet containing apparatus according to claim 1, wherein said fit portions are fit holes opened along a horizontal direction, and wherein said positioning members are lock pins vertically movable to be fitted into the fit holes.

4. A sheet containing apparatus according to claim 3, comprising operating means for engaging said lock pins with said fit holes, wherein said operating means includes:

a connecting member horizontally movable through operation of an operating portion; and a cam rotatable with a movement of said connecting member, wherein said lock pins are moved vertically in accordance with rotation of said cam so that said pins are engaged with said fit holes.

5. A sheet containing apparatus according to claim 1, comprising an openable and closable door for inserting sheets in said sheet stacking means in said main body, wherein said regulating member is arranged in a depth side of said main body, and wherein said operating means for engaging said positioning members with said fit portions is arranged on a door side.

6. A sheet containing apparatus according to claim 1, comprising:

two gears coaxially provided at opposite ends of said regulating member; and rack portions of the same configuration and the same phase as one another provided in said main body, said rack portions being engageable with said gears, respectively.

7. A sheet containing apparatus according to claim 6, wherein said gears are arranged in upper and lower portions of said regulating member, and wherein said racks are respectively arranged in the upper and lower portions of said main body.

8. A sheet containing apparatus comprising:

a sheet stacking table ascendable and descendible in a sheet storage and for supporting sheets of various sizes;

a regulating member movable for abutting against edges of the sheets stacked on said sheet stacking table to regulate a position of the sheets;

a pair of lock pins supported by said regulating member so as to be vertically movable; and fit holes which are formed in upper and lower portions of the sheet storage and into which said lock pins are fitted, wherein said fit holes are formed in positions in which said lock pins are fitted into said fit holes in positions in which said regulating member abuts against the sheets stacked on said sheet stacking table.

9. A sheet containing apparatus according to claim 8, comprising operating means for engaging said lock pins with said fit holes, wherein said operating means includes:

a connecting member horizontally movable through operation of a lock lever; and a cam rotatable with a movement of said connecting member, wherein said lock pins are moved vertically in accordance with rotation of said cam so that said lock pins are engaged with said fit holes.

10. A sheet containing apparatus according to claim 9, comprising an openable and closable door for inserting sheets in said sheet stacking table in the sheet storage, wherein said regulating member is arranged in a depth side of the sheet storage, and wherein said lock lever for engaging said lock pins with said fit holes is arranged on a door side.

11. A sheet containing apparatus according to claim 8, comprising:

a rotation shaft provided in said regulating member along a vertical direction;

pinion gears attached to upper and lower portions of said rotation shaft; and rack portions provided in the upper and lower portions of the sheet storage along a direction in which said regulating member moves, said rack portions being engaged with said pinion gears.

12. A sheet feeding apparatus comprising:

sheet stacking means, which is provided in a main body of said sheet feeding apparatus and on which sheets are stacked;

a regulating member movable according to a size of the sheets stacked on said sheet stacking means and for abutting against edges of the stacked sheets to regulate a position of the sheets;

sheet supplying means for feeding out the sheets, of which the position has been regulated by said regulating member;

an upper fit portion and a lower fit portion provided at positions corresponding to the size of the sheets stacked on said sheet stacking means in an upper portion and a lower portion of said main body;

an upper positioning member and a lower positioning member provided on said regulating member and for being fitted into said fit portions; and operating means for engaging said positioning member with said fit portions, wherein said upper positioning member is engaged with said upper fit portion and said lower positioning member is engaged with said lower fit portion by one operation of said operating means.

13. A sheet feeding apparatus comprising:

a sheet stacking table ascendable and descendible in a sheet storage and for supporting sheets of various sizes;

a regulating member movable for abutting against edges of the sheets stacked on said sheet stacking table to regulate a position of the sheets;

a pair of lock pins supported by said regulating member so as to be vertically movable;

fit holes which are formed in upper and lower portions of the sheet storage and into which said lock pins are fitted; and a sheet supply roller for feeding out the sheets by rotating while abutting against an upper surface of the sheets, of which the position has been regulated by said regulating member, wherein said fit holes are formed in positions in which said lock pins are fitted into said fit holes in positions in which said regulating member abuts against the sheets stacked on said sheet stacking table.

14. An image forming apparatus comprising:

sheet stacking means, which is provided in a main body of said image forming apparatus and on which sheets are stacked;

a regulating member movable according to a size of the sheets stacked on said sheet stacking means and for abutting against edges of the stacked sheets to regulate a position of the sheets;

sheet supplying means for feeding out the sheets, of which the position has been regulated by said regulating member;

image forming means for forming an image on a sheet fed by the sheet supplying means;

an upper fit portion and a lower fit portion provided at positions corresponding to the size of the sheets stacked on said sheet stacking means in an upper portion and a lower portion of said main body;

an upper positioning member and a lower positioning member provided on said regulating member and for being fitted into said fit portions; and operating means for engaging said positioning members with said fit portions, wherein said upper positioning member is engaged with said upper fit portion and said lower positioning member is engaged with said lower fit portion by one operation of said operating means.

15. An image forming apparatus comprising:

a sheet stacking table ascendable and descendible in a sheet storage and for supporting sheets of various sizes;

a regulating member movable for abutting against edges of the sheets stacked on said sheet stacking table to regulate a position of the sheets;

a pair of lock pins supported by said regulating member so as to be vertically movable;

fit holes, which are formed in upper and lower portions of the sheet storage and into which said lock pins are fitted;

a sheet supply roller for feeding out the sheets by rotating while abutting against an upper surface of the sheets, of which the position has been regulated by said regulating member; and an image forming portion for forming an image on a sheet fed by said sheet supply roller, wherein said fit holes are formed in positions in which said lock pins are fitted into said fit holes in positions in which said regulating member abuts against the sheets stacked on said sheet stacking table.

* * * * *

UNITED STATES PATENT AND TRADEMARK OFFICE

CERTIFICATE OF CORRECTION

PATENT NO. : 6,871,848 B2
DATED : March 29, 2005
INVENTOR(S) : Akira Matsushima et al.

It is certified that error appears in the above-identified patent and that said Letters Patent is hereby corrected as shown below:

Title page,
Item [56], References Cited, FOREIGN PATENT DOCUMENTS,
"02100930" should read -- 2-100930 --;
"04104480" should read -- 4-104480 --;
"04350024" should read -- 4-350024 --;
"05105266" should read -- 5-105266 --;
"05278870" should read -- 5-278870 --;
"06016247" should read -- 6-16247 --; and
"06024578" should read -- 6-24578 --.

Column 10,
Line 21, "descendible" should read -- descendable --.

Column 12,
Line 24, "descendible" should read -- descendable --.

Signed and Sealed this

Nineteenth Day of July, 2005

JON W. DUDAS
*Director of the United States Patent and Trademark Office*